United States Patent [19]

Rogers, Jr.

[11] 4,185,869

[45] Jan. 29, 1980

[54] TWO-WAY WALL-AVOIDING RECLINER CHAIR

[76] Inventor: Walter C. Rogers, Jr., P.O. Box 685, Denton, N.C. 27239

[21] Appl. No.: 815,293

[22] Filed: Jul. 13, 1977

[51] Int. Cl.[2] ..... A47C 1/02

[52] U.S. Cl. ..... 297/84; 297/68

[58] Field of Search ..... 297/68, 84, 85, 86, 297/83, 87, 317, 75, 322

[56] References Cited

U.S. PATENT DOCUMENTS

| | | | |
|---|---|---|---|
| 2,892,485 | 6/1959 | Schliephacke | 297/88 |
| 3,164,407 | 1/1965 | Schliephacke | 297/85 |
| 3,433,527 | 3/1969 | Re' | 297/83 X |
| 3,493,264 | 2/1970 | Re' | 297/75 X |
| 3,522,969 | 8/1970 | Re' | 297/89 X |
| 3,874,724 | 4/1975 | Re' | 297/88 |
| 3,941,417 | 3/1976 | Re' | 297/85 |
| 3,958,827 | 5/1967 | Re' | 297/85 X |

*Primary Examiner*—James T. McCall

*Attorney, Agent, or Firm*—William E. Mouzavires

[57] ABSTRACT

A two-way wall-avoiding recliner chair including a seat and a backrest rigidly interconnected to move together as a unit relative to a fixed base to which the seat is mounted by a linkage for movement between a normal position in which the backrest is generally upright and a first reclining position in which the seat has been advanced forwardly relative to the base. A footrest is in retracted position at the front of the seat when the latter is in the normal position and is in extended position forwardly of the seat when the seat is placed into the first reclining position known as TV position. From the TV position, the seat and backrest unit may be moved into further reclined positions, including a fully reclined position with the footrest remaining extended but slightly adjusted downwardly for reclining comfort. Actuation of the seat and backrest unit between the normal and TV positions is achieved through the armrests which are mounted to the seat while also being connected to the footrest to actuate the latter. Actuation of the seat and backrest unit into the fully reclined position is achieved by the chair occupant exerting back pressure on the backrest which opens a four-bar linkage which includes the seat. This action also results in moving the seat forwardly a certain amount relative to the base. A sequencing linkage is provided between the footrest and the seat for preventing retraction of the footrest when the seat is in the fully reclined position and for preventing movement of the chair into full recline position unless the footrest is in extended position.

22 Claims, 7 Drawing Figures

TWO-WAY WALL-AVOIDING RECLINER CHAIR

BACKGROUND OF INVENTION

"Two-way" recliner chair is a term used in industry to describe a recliner chair whose seat and backrest are interconnected such as by a rigid interconnection to move together as a unit between generally upright and reclining positions relative to a fixed primary support structure such as a base, for example. This is to be contrasted with a "three-way" reclining chair in which the seat and back are free to move relative to each other as the chair moves between the upright and reclining positions. The term "wall-avoiding" is used herein to describe a reclining chair which may be a two-way reclining chair or a three-way reclining chair in which the seat moves forwardly relative to a base support structure when moving to reclining positions so that the chair may be placed adjacent a wall without the backrest striking the wall when the chair is moved into reclining positions.

The present invention relates to a two-way wall-avoiding reclining chair and although such chairs as a braod category are not new to the art, the present invention provides a novel and improved chair of the type indicated. Prior to the present invention, two-way wall-avoiding recliner chairs were characterized by including a basic support structure in the form of the armrests of the chair with the backrest and seat assembly being mounted to the armrests. The wall-avoiding travel of the backrest and the seat assembly was achieved by the chair occupant exerting pressure on the backrest which was utilized to drive the armrests rectilinearly forwardly along a track or an equivalent restraining guide system. The use of such a track system has disadvantages because the tracks require precision construction and assembly to prevent jamming of parts in the track and malfunctioning of the chair movement after repeated usage of the chair. The vibration of parts moving along the track is also thought to create a discomforting feeling to the chair occupant. In adition, to achieve the necessary wall-avoiding travel not only must the armrests be moved forwardly along the tracks but furthermore, in some cases, additional linkage systems must be provided for ensuring sufficient wall-avoiding travel of the seat and backrest; the result being that the linkage mechanism becomes complicated and expensive because of the number of parts required. A two-way recliner chair utilizing a track system to provide wall-avoiding action are shown in United States patent to Re' U.S. Pat. No. Re. 28,210.

OBJECTS OF THE PRESENT INVENTION

The present invention has, for its object, the provision of a novel and improved two-way wall-avoiding reclining chair which is free of the aforementioned drawbacks attendant prior art chairs of this general type. Included within this object is the provision of such a two-way chair which does not utilize a track system for achieving wall-avoiding action but rather uses a linkage system actuated by the armrests of the chair which are mounted to the seat to move the seat between upright and reclined positions relative to a fixed supporting base on which the seat is mounted.

Another object of the present invention is to provide such a two-way reclining chair having a footrest which is extended simultaneously with movement of the seat and backrest into a reclining position through energy derived from the armrests of the chair which not only drive the seat with wall-avoiding action forwardly but also drive the footrest.

A further object of the present invention is to provide such a two-way reclining chair which may be placed into a further advanced reclining position beyond a TV position providing a highly comfortable reclining posture with the footrest extended at a comfortable elevation relative to the reclined seat and backrest. Included herein is the provision of such a chair whose footrest will be positively maintained in the extended position against accidental retraction when the chair is in the fully reclined position.

A further object of the present invention is to provide novel linkage systems for a two-way wall-avoiding recliner chair which will achieve the above objects and which linkage systems are comprised of a reduced number of parts reducing the cost of manufacture and assembly and without sacrificing performance of the chair when moving between its various positions.

SUMMARY OF INVENTION

By way of summary, the present invention is carried out in one specific embodiment which includes a seat and backrest rigidly interconnected and mounted to a fixed base by means of a seat linkage which includes a four-bar linkage, one link of which is rigidly fixed to the seat; and a mounting linkage mounting the four-bar linkage relative to the base for movement between a normal position wherein the backrest extends generally upright and a first reclining or TV position wherein the seat and backrest have been advanced as a unit forwardly of the base with wall-avoiding travel and swung into a reclined position relative to the base.

Actuation of the seat and backrest assembly between the aforementioned positions is achieved through the armrests which are uniquely mounted to the seat linkage and connected by an actuating linkage to one of the mounting links to drive the same. The footrest which has a footrest linkage mounted to the seat linkage is simultaneously operated from retracted to extended positions when the seat and backrest assembly are actuated, by means of a transmission link interconnecting the armrest linkage and the footrest linkage.

In order to place the chair into further or advanced reclining positions beyond the TV position, the four-bar linkage of the seat linkage is opened by the chair occupant exerting back pressure on the backrest by pushing off the armrests which not only places the seat into a further reclined position relative to the base but further advances the seat forwardly relative to the base to provide a certain amount of added wall-avoiding travel.

A sequencing linkage is provided between the footrest linkage and the seat linkage to prevent retraction of the footrest when the chair is in a fully reclined position so as to avoid accidental, discomforting retracting of the footrest. The sequencing linkage also prevents opening of the four-bar seat linkage and consequent advanced reclining movement of the seat and backrest unit until the footrest has been extended.

In order to positively define the upright, TV and fully reclined positions, a plurality of stop mechanisms are provided.

DRAWINGS

Other objects and advantages of the present invention will become apparent from the following more detailed description taken in conjunction with the drawings in which.

DETAILED DESCRIPTION

Basic Chair Parts and Operation

Figure 1C:
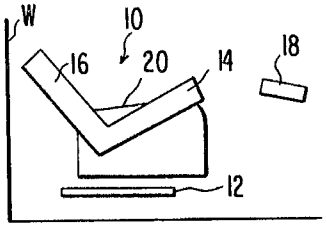
FIGS. 1A, 1B and 1C are diagrammatic side views illustrating upright, TV and fully reclined positions respectively of a two-way wall-avoiding chair according to the present invention.
Figure 1B:
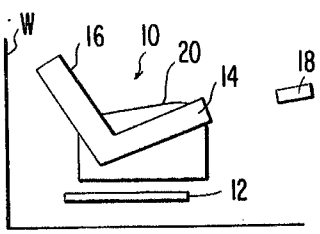
Figure 1A:
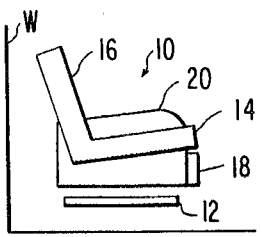

Referring now to the drawings in detail, there is shown for illustrative purposes only, a two-way wall-avoiding recliner chair generally designated 10 embodying the present invention and capable of movement between a normal or upright position shown in FIG. 1A; a TV position shown in FIG. 1B; a full recline position shown in FIG. 1C; and any number of balanced, advanced reclining positions (not shown) between TV position and full recline position. Chair 10 includes a base generally designated 12; a seat and backrest assembly including a seat 14 and a backrest 16 rigidly interconnected to the seat 14 for movement as a unit relative to the base between the normal or upright position shown in FIG. 1A and the reclining positions shown in FIGS. 1B and 1C. In addition, the chair includes a footrest generally designated 18 mounted relative to the seat 14 for movement between a retracted position shown in FIG. 1A and extended positions shown in FIGS. 1B and 1C. In addition, the chair includes armrests 20 (one shown) uniquely mounted to the seat to drive the seat and backrest unit between normal and upright positions shown in FIGS. 1A and 1B respectively and for also providing wall-avoiding travel of the seat and back unit forwardly relative to the base 12 when the chair is moved from the upright position shown in FIG. 1A to the TV position shown in FIG. 1B.

As shown in FIG. 1A, the chair in the upright or normal position has its backrest 16 in generally upright position with the footrest 18 in retracted position where it extends vertically downward at the front of the seat 14. A nearby wall W is also shown to illustrate wall-avoiding action upon reclining of the chair.

In FIG. 1B, the armrests 20 have been moved by the chair occupant (not shown) forwardly relative to the base 12 to move the seat and backrest assembly also forwardly relative to the base 12 with wall-avoiding action while, at the same time, causing the seat and backrest assembly to pivot or be swung into a reclining position shown in FIG. 1B. It should be noted that in the TV position shown in FIG. 1B, backrest 16 has been moved away from wall W. Further, in the TV position shown in FIG. 1B, footrest 18 has been extended forwardly of the seat, and will be described below. This is achieved simultaneously with movement of the seat and backrest assembly as described by a drive emanating from the armrests 20 which are connected to the footrest to drive the same.

From the TV position shown in FIG. 1B the chair may be placed into a number of advanced reclining positions; and the fully reclined position is shown in FIG. 1C where the seat and backrest assembly have been pivoted or swung into a more pronounced reclining position but notwithstanding the latter, the backrest 16 is still slightly spaced from the wall W by virtue of the wall-avoiding travel achieved when the chair was moved to the TV position shown in FIG. 1B. In addition, when moving from the TV position shown in FIG. 1B to the fully reclined position shown in FIG. 1C, a slight amount of added wall-avoiding travel takes place in the seat and backrest assembly, however, this is barely visible in FIG. 1C.

Actuation of the chair into the fully reclined position shown in FIG. 1C is achieved by the chair occupant exerting back pressure on the backrest 16 by pushing off the armrests 20 which has the effect of opening up a seat linkage to be described below which, in turn, causes the fully reclined position to be achieved. When the chair is in the fully reclined position shown in FIG. 1C, footrest 18 is not subject to accidental retraction which could be discomforting to the chair occupant, and this is achieved through a sequencing linkage, to be described below, connected between the footrest and the seat linkages. Finally, it is noted that while the seat and backrest assembly have been placed into an advanced reclining position shown in FIG. 1C, the footrest 18 has been slightly lowered relative to the seat in order to place the legs of the chair occupant at a comfrotable position compatible with the fully reclined position of the seat.

Because of the balance of the linkage system which may be achieved by the chair occupant through applying pressure on the backrest, the chair may be placed into a number of advanced reclining positions between the TV position shown in FIG. 1B and the fully reclined position shown in FIG. 1C. In order to return the chair to the TV position shown in FIG. 1B from the fully reclined position shown in FIG. 1C, the occupant merely has to lean forward in the chair or to remove back pressure from the backrest which will automatically cause a weight distribution causing the linkage to return the chair to the TV position shown in FIG. 1B. In order to return the chair to the normal position of FIG. 1A from the TV position shown in FIG. 1B, the occupant merely has to exert downward leg pressure on the footrest to fold the footrest to retracted position which will also serve to return the seat linkage rearwardly along the base.

The Chair Frame and Upholstery

Figure 2:
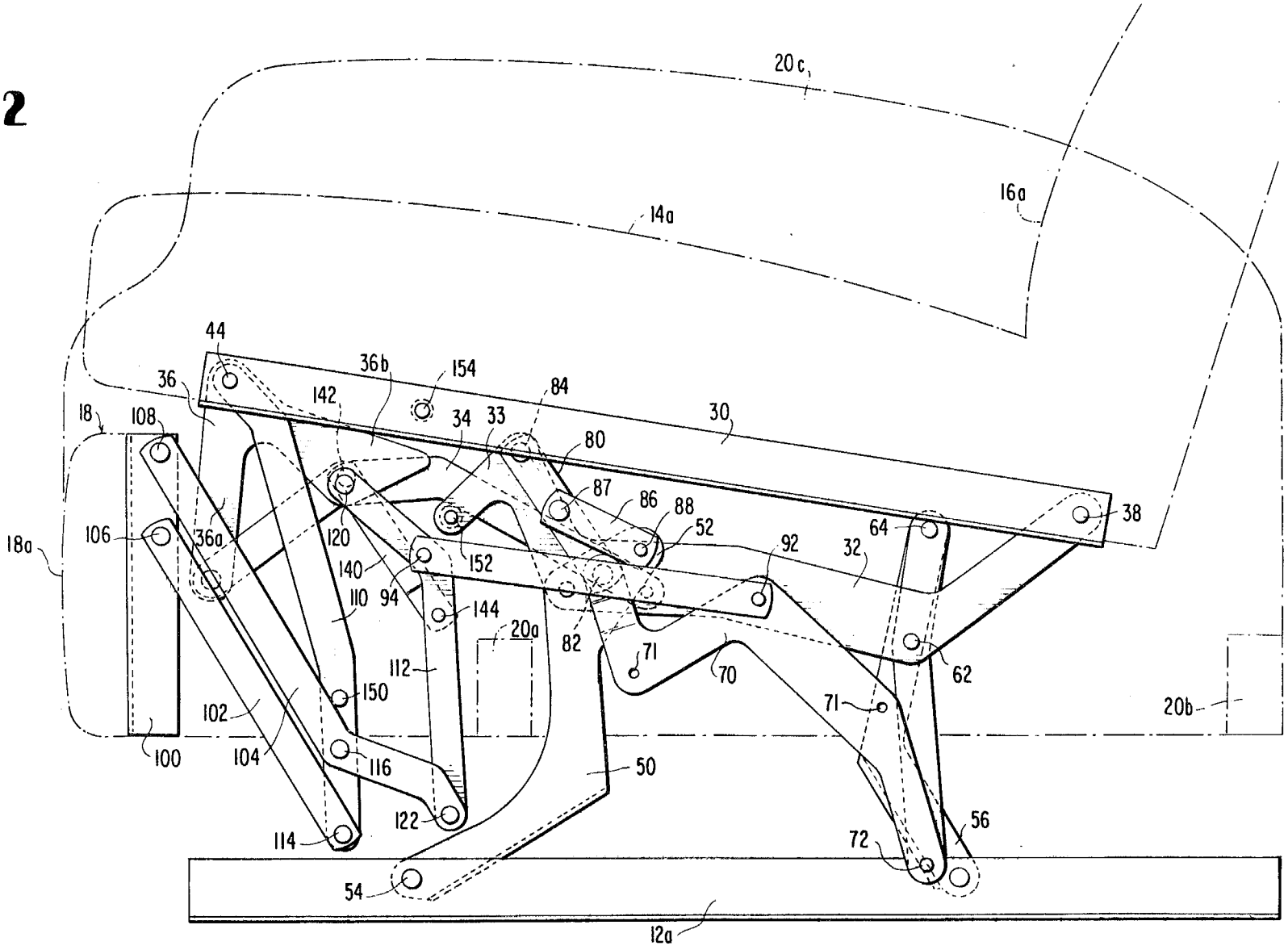
FIG. 2 is a side elevational view of a two-way wall-avoiding chair constituting a preferred embodiment of the invention (with certain upholstery parts removed to expose the linkage) when the chair is in the normal or upright position and as seen from outside the left-hand side of the chair.

Since the recliner chair of the present invention is of the two-way type, the backrest 16 and seat 14 are interconnected to move as a unit and in the preferred embodiment, this is achieved through a rigid interconnection of their frame parts which may be of any suitable conventional type made from wood or other suitable material and therefore need not be shown. Upholstery for the seat and backrest are shown in FIG. 2 generally by the numerals **14*a* and 16*a*. The armrests 20 may also have any suitable conventional frame construction such as may include side rails (not shown) and cross rails 20*a* and 20*b* interconnecting the side rails. In FIG. 2 the armrest upholstery is shown by the numeral 20c while the footrest upholstery is indicated by 18a**.

The fixed base 12 which rests on the floor may be made from any suitable structure, and in the preferred embodiment shown, includes a pair of side rails 12a (one shown in FIG. 2) which may be provided with nylon bearing or other floor-engaging low friction means (not shown). In addition, and although not shown, base side rails 12a may be interconnected by cross members.

The linkage systems which preferably are comprised of steel bars, for mounting and operating the various parts of the chair will now be described but since there are two linkage systems on each side of the chair with one linkage system being a mirror image of the other, only one linkage system need be described.

The Seat Linkage

Figure 3:
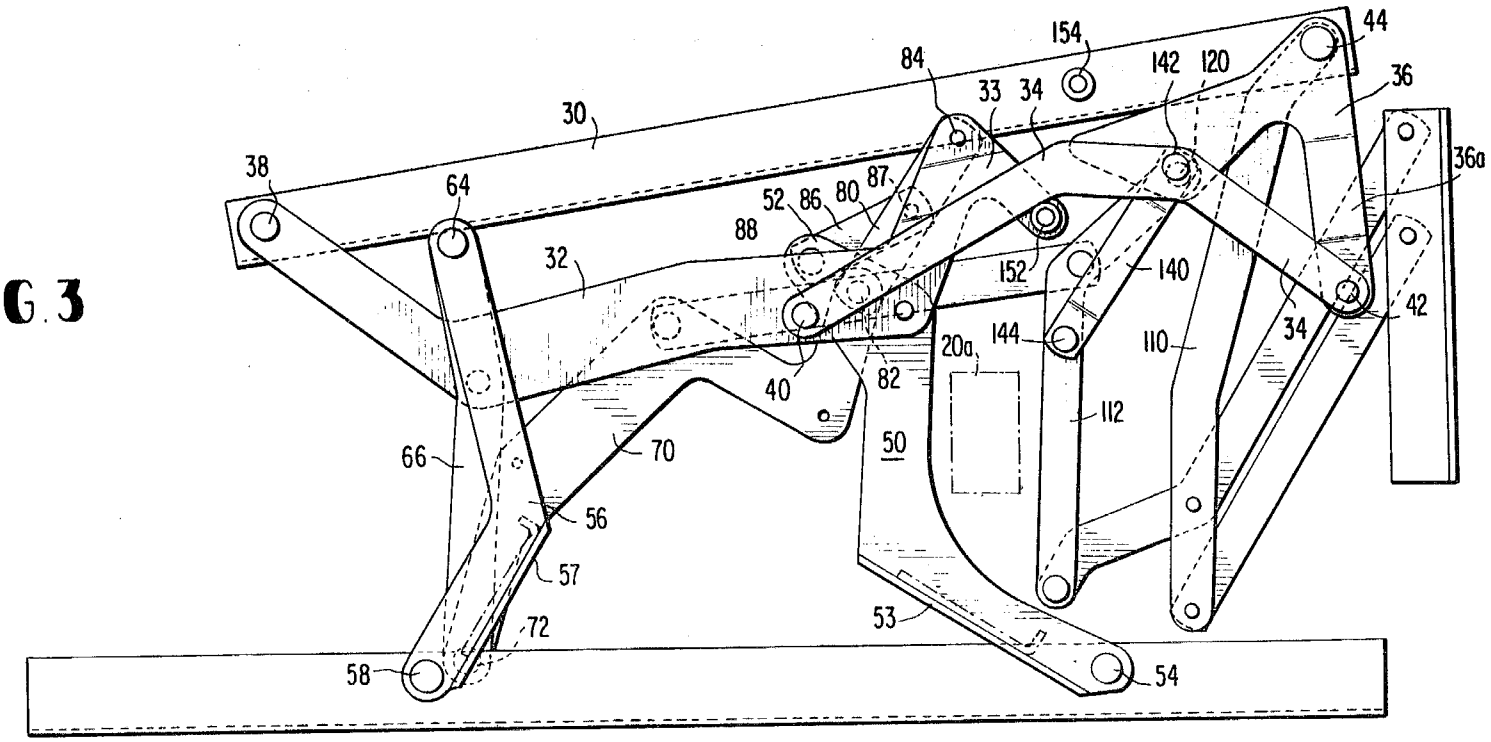
FIG. 3 is a side elevational view of the same linkage shown in FIG. 1 except as would be seen from inside the chair.
Figure 4:
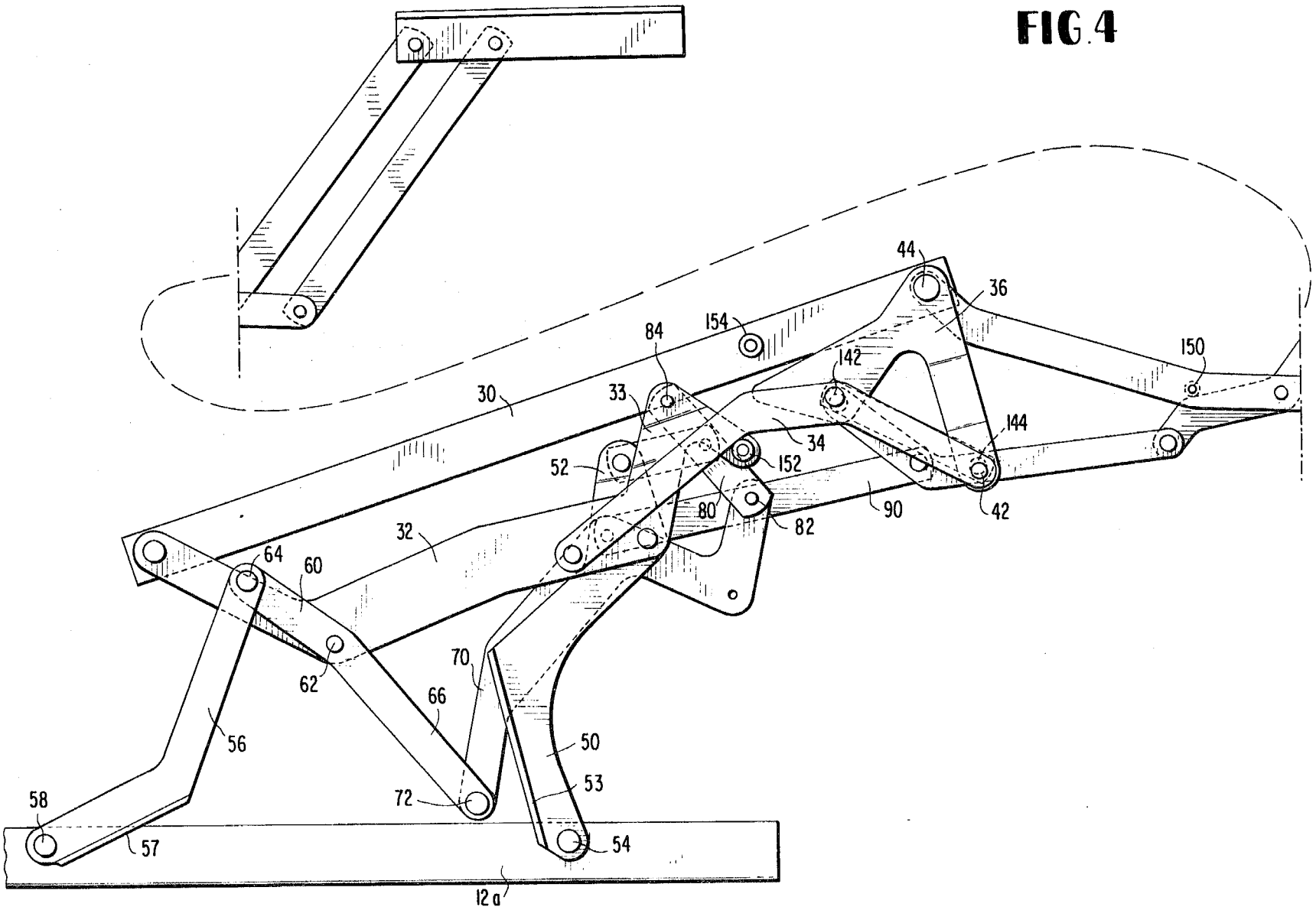
FIG. 4 is a view generally similar to FIG. 2 except with the linkage system being shown in the position occupied when the chair is in the TV position.

FIGS. 2 through 5 disclose linkage systems constructed and arranged in accordance with the preferred embodiment of the present invention. Focusing first on the seat 14 and the backrest 16 which are rigidly interconnected, this assembly is provided with what will be termed a "seat linkage" which includes a four-bar linkage comprised of links 30, 32, 34 and 36 which extends in a vertical plane in the forward-rearward direction of the chair. Link 30 is an elongated straight bar which extends in the forward-rearward direction of the chair and is fixed to a lower frame portion of the seat by any suitable means (not shown) so as to move with the seat in all positions. Link 30 may therefore be termed a "main seat link." Seat link 32 has its rear end pivotally connected by pivot 38 to the rear end of main seat link 30 and from pivot 38, seat link 32 extends downwardly and then forwardly and then upwardly at 33 as best shown in FIGS. 3 and 4. Referring again to FIGS. 3 and 4, seat link 34 has its rear end pivotally connected by pivot pin 40 to an intermediate portion of seat link 32 and has its forward end pivotally connected by pivot pin 42 to the forward leg 36a of the remaining seat link 36. Seat link 36, as clearly shown in the drawings, has a generally inverted L-shape while being pivotally mounted at the juncture of its legs 36a and 36b by pivot pin 44 to the forward end of main seat link 30 while having its forward leg 36b pivoted by pin 42 to seat link 34 as described.

Figure 5:
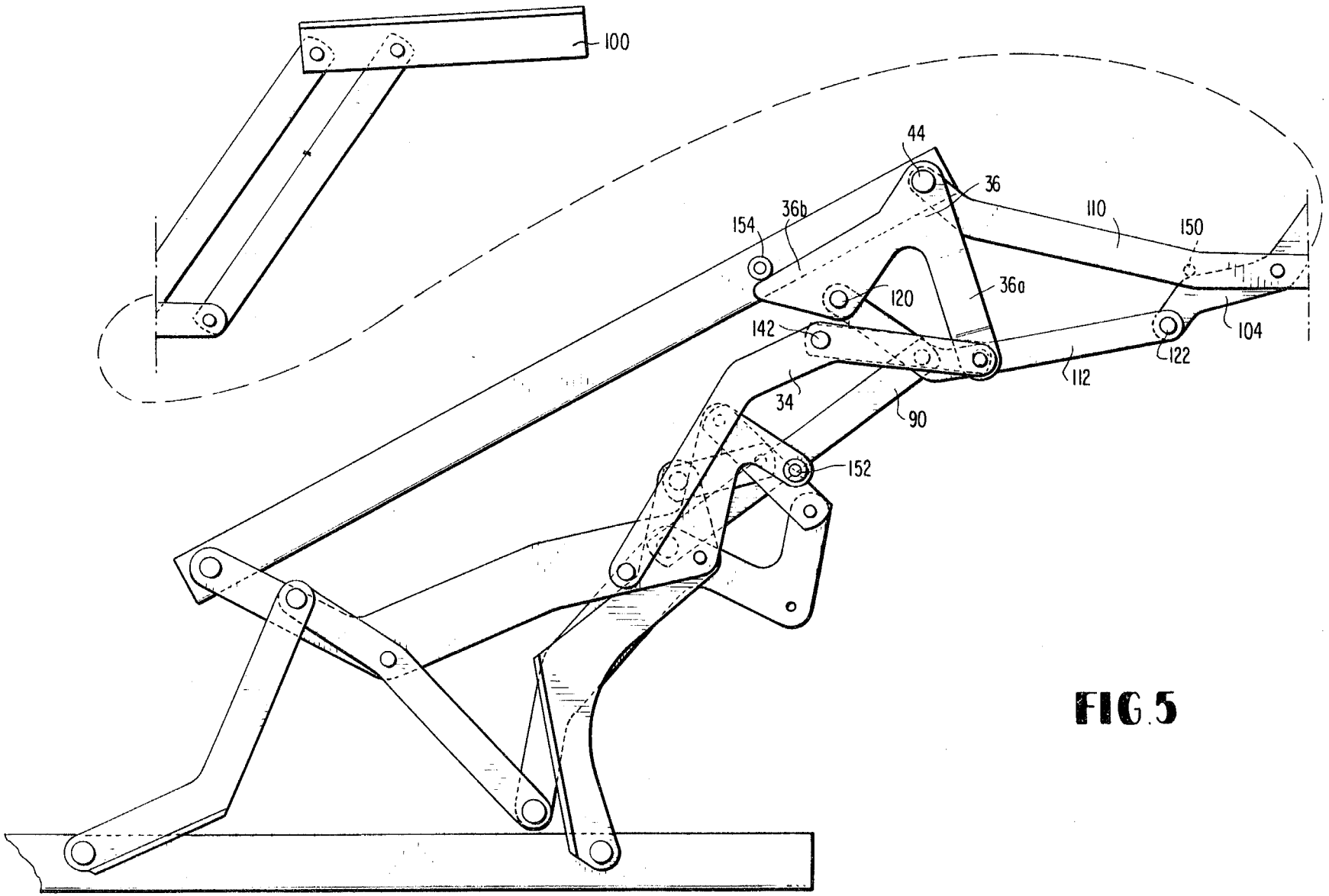
FIG. 5 is a view generally similar to FIG. 4 except that the linkage is shown in the fully reclined position.

As will become clearer below, the seat linkage comprised of the four-bar linkage 30, 32, 34 and 36 remains closed in the position shown in FIGS. 2, 3 and 4 when the chair moves from the upright position shown in FIGS. 1A, 2 and 3 to the TV position shown in FIG. 1B and FIG. 4. In order to move the chair into advanced reclining positions including the full recline position such as shown in FIG. 1C and FIG. 5, it is necessary to open the four-bar linkage which, of course, is achieved by relative movement of its parts into the position shown in FIG. 5. This action will be described further below.

The Seat Mounting Linkage

The seat including its seat linkage just described, is mounted for movement on base 12 between normal upright position shown in FIG. 1A and the reclining positions shown in FIGS. 1B and 1C by means of what will be referred to as a "mounting linkage" or a "seat mounting linkage." This linkage includes what will be referred to as a "main mounting link" 50 having a generally reversed L-shape including an upper crank portion 52 and an opposite lower portion pivotally mounted by pivot pin 54 to the base 12 at a forward portion of the base as best shown in FIGS. 3 and 4. As will be described below, the upper portion 52 of main mounting link 50 is connected to an actuating linkage to drive the seat and backrest assembly through the seat linkage.

The seat mounting linkage further includes a secondary mounting link 56 pivotally mounted by pivot pin 58 to the base 12 at a location rearwardly of the mounting by pivot 54 of main mounting link 50 as best shown in FIG. 4. The upper end of secondary mounting link 56 is pivotally mounted to the seat linkage through means of a link 60 pivoted by pin 62 to mounting link 32 and having an opposite end portion pivotally connected by pivot pin 64 to the upper end of secondary mounting link 56 as best shown in FIG. 4. In the specific embodiment shown and again with reference to FIG. 4, link 60 is included as part of a link which includes a link 66 utilized for mounting the armrests to the seat linkage as will be described in the following paragraph.

Movement of the chair between the upright position shown in FIG. 1A and the TV position shown in FIG. 1B is achieved by actuating the main mounting link 50 so as to move it in a clockwise direction as viewed in FIG. 3 about pivot 54 which has the effect of moving the entire seat linkage 30, 32, 34 and 36 as a unit forwardly relative to the base 12 to provide desired wall-avoiding travel and also to place the seat and backrest unit into an inclined position shown in FIGS. 1B and 4.

The Armrest and Actuating Linkages

As noted above, armrests 20 are mounted to the seat and furthermore serve to actuate the seat and backrest unit from the upright to the TV positions. This is achieved in the specific embodiment shown through an armrest linkage and an actuating linkage. Armrest linkage includes a first link 70 which is fixed by any suitable means such as through the apertures 71 (see FIG. 2) directly to the internal frame structure of the associated armrest 20 so as to move as a unit with the armrest 20. The lower end of armrest linkage 70 is pivoted by pivot pin 72 to the lower end of a second armrest link 66 which, in the specific embodiment shown, is formed together with link 60 as a single link pivoted intermediate its ends by pivot 62 to the seat link 32 as described above.

The actuating linkage serves to connect the armrest linkage to the seat linkage to drive the same so as to move the seat and back assembly between the upright and reclining positions. In the specific embodiment shown, the actuating linkage includes a first link 80 having one end pivotally connected by pivot pin 82 to the forward end of armrest link 70 and having its opposite end pivotally connected by pivot pin 84 to the forward end portion 33 of seat mounting link 32 as best shown in FIGS. 2 and 4. Actuating linkage further includes a short link 86 having one end pivotally connected by pivot pin 87 to an intermediate portion of the first actuating link 80 and an opposite end pivotally connected by pivot pin 88 to the upper crank portion 52 of main seat mounting link 50 as best shown in FIGS. 2 and 3. It will be seen that when armrests 20 are moved forwardly relative to the base from the normal position shown in FIG. 1A to the TV position shown in FIG. 1B, the armrest link 70 will drive the actuating linkage 80, 86 which in turn will drive the main seat mounting link 50 in a clockwise direction as viewed in FIG. 3 about pivot 54 to swing the seat linkage 30, 32, 34 and 36 from the position shown in FIG. 3 into the reclining position shown in FIG. 4 and the latter is achieved with wall-avoiding travel so that the entire seat linkage is displaced forwardly relative to the base. It should be noted that during the latter motion, the four-bar linkage 30, 32, 34 and 36 remains closed and its parts move as a unit without relative movement.

Simultaneously with movement of the backrest and seat assembly from the upright to the TV position by movement of the armrests as described above, footrest 18 is also projected forwardly from the retracted position shown in FIG. 1A into the extended TV position shown in FIG. 1B. This is achieved by another actuating linkage connected between the armrest linkage 70 and the footrest linkage. For purposes of differentiating over the actuating linkage 80, 86, the actuating link 90 for the footrest may be termed a "transmission link" since it transmits movement from the armrest linkage to the footrest linkage when the armrests are moved forwardly to place the chair in TV position and also transmits movement from the footrest linkage to the armrest linkage to move the seat linkage forwardly with a slight amount of wall-avoiding travel when the chair is placed into the fully reclined position as will be described below. In addition, transmission link 90 transmits movement from the footrest linkage to the seat mounting linkage 50 to return the chair from TV position to upright position as will be described below. The rear end of transmission link 90 is connected by pivot pin 92 to an intermediate portion of armrest link 70. The opposite, forward end of transmission link 90 is connected by pivot pin 94 to the footrest linkage which will now be described.

THE FOOTREST LINKAGE

Footrest 18 is mounted to the seat linkage for movement between extended and retracted positions by a footrest linkage including a bracket link 100 fixed to the upholstered frame **18*a* of the footrest, and having pivotally connected thereto a pair of parallel links 102, 104, the pivot pins between these parts being designated 106 and 108 in FIG. 2. The footrest linkage is mounted to the seat linkage by footrest mounting links 110 and 112. Footrest mounting link 110 has its upper end pivotally mounted by pivot pin 44 which also mounts the L-shaped seat mounting link 36, to the forward end of main seat link 30. The opposite lower end of footrest mounting link 110 is pivotally connected by pivot pin 114 to the rear end of parallel link 102. In addition, footrest mounting link 110 is pivotally connected by pivot pin 116 to an intermediate portion of parallel link 104 so that parallel links 102, 104, together with portions of links 100 and 110 located between pivots 106 and 108, and 114 and 116**, respectively, from a parallelogram linkage.

The other footrest mounting link 112 is pivotally mounted at its upper end by pivot pin 120 to the rearward projecting leg **36*b* of seat link 36 as best shown in FIG. 5. The opposite lower end of footrest mounting link 112 is pivotally connected by pivot pin 122 to the rear end portion of parallel link 104. In addition, as noted above, transmission link 90 which is connected to the armrest link 70 at one end, is connected at the other end by pivot pin 94 to an intermediate portion of footrest mounting link 112** so as to drive the footrest linkage to extend position when the armrests are moved forwardly relative to the base.

Thus, when armrests 20 are moved forwardly relative to the base from the normal or upright position shown in FIGS. 1A, 2, and 3 to the TV position shown in FIGS. 1B and 4, transmission link 90 will be moved forwardly to swing the footrest mounting link 112 about its pivot 120 to the seat link 36 in a clockwise direction as viewed in FIG. 2 (counterclockwise as viewed in FIG. 3) which, in turn, will project the footrest into the position shown in FIG. 4.

As noted above, when the chair moves from the TV to the fully reclined position, the seat linkage 30, 32, 34 and 36 opens to place seat link 30 at a steeper angle of inclination for advanced reclining comfort. This opening of the four-bar seat linkage causes the L-shaped seat link **36*a* to undergo pivotal movement about its pivot 44 to main seat link 30** in a clockwise direction as viewed in FIGS. 4 and 5 which has the effect of pivoting the footrest linkage slightly downwardly relative to the seat so that even though the footrest linkage as a unit has been elevated by virtue of the full recline position of the seat linkage as shown in FIGS. 1C and 5, the position of the footrest will be adjusted downwardly relative to the seat to place it in a comfortable position compatible with the fully reclined position.

Movement of the chair to the full reclined position also has another effect, namely to provide a certain amount of added wall-avoiding travel of the entire seat linkage forwardly relative to the base. This is achieved by the fact that transmission link 90 is pulled upwardly and forwardly a certain amount when the footrest linkage is placed into the fully reclining position. This has the effect of moving the seat linkage slightly forwardly by means of the armrest linkage 70 and 66 which is connected to the rear seat mounting link 56 to pull the latter forwardly in slight swinging movement about its pivot 58 to the base. This added wall-avoiding travel ensures that the backrest does not strike the wall W when the chair moves into the fully reclined position.

In order to return the footrest to the retracted position from the TV position, the chair occupant merely has to press down with the legs on the footrest 18 which will cause the footrest linkage to fold into the retracted position which, in turn, will move the seat mounting linkage and in turn the seat linkage back to the position occupied when the chair is in the normal or upright position. In many cases, the chair occupant in addition to pressing down on the footrest 18 will also move the armrests 20 rearwardly in order to return the chair to the upright position of FIG. 1A.

Sequencing Linkage

In order to prevent accidental retraction of the footrest when the chair is in the fully reclined position, a sequencing linkage is provided between the seat linkage and the footrest linkage. The sequencing linkage also prevents opening of the four-bar seat linkage 30, 32, 34 and 36 such as would allow advanced reclining movement, unless the footrest is in extended position. In the specific embodiment shown, the sequencing linkage includes a sequencing link 140 having one end pivotally connected by pivot pin 142 of an intermediate portion of seat link 34 and having its opposite end pivotally connected by pivot pin 144 to an intermediate portion of footrest mounting link 112 as best shown in FIG. 3.

In the closed position of the linkage system, as shown in FIGS. 2 and 3, that is, when the chair is in the upright position shown in FIG. 1A, pivot pin 142 (which connects sequencing link 140 to seat link 34) will be substantially concentric with pivot pin 120 (which connects footrest mounting link 112 to seat link 36). Further, in this closed position of the linkage system, sequencing link 140 extends downwardly and rearwardly from its pivot 142 and with its lower pivotal connection 144 to footrest mounting link 112 being located rearwardly and out of concentricity with pivot 42 between seat links 34 and 36 as shown in FIG. 3. This position of the sequencing link 140 prevents opening of the four-bar seat linkage 30, 32, 34 and 36 unless the footrest is in extended position. This prevents accidental placement of the chair to advanced reclining position as long as the footrest remains retracted. Moreover, this position of the sequencing link 140 prevents any reclining of the chair to the TV position without the use of the armrests in the manner described above.

However, when the chair is moved into the TV position shown in FIGS. 1B and 4, it will be noted that sequencing link 140 moves counterclockwise as viewed in FIGS. 3 and 4 about its pivot 142 and becomes positioned as shown in FIG. 4 with its pivot 144 substantially concentric with pivot 42 between seat links 34 and 36. This positioning of sequencing link 140 permits the four-bar seat linkage 30, 32, 34 and 36 to be opened when the chair occupant exerts pressure on the backrest so as to place the chair into the fully reclined position shown in FIGS. 1C and 5. It will further be seen that the sequencing link 140 also functions to maintain the footrest in the extended position when the chair is in the fully reclined position shown in FIGS. 1C and 5. It will also be noted from FIG. 5 that when the chair moves into the fully reclined position by the opening of the four-bar seat linkage 30, 32, 34 and 36, pivots 120 and 142 move out of concentricity with pivot 120 moving above pivot 142. In order to return the chair to the TV position, the occupant merely has to lean forward in the chair which will have the effect of closing the four-bar linkage 30, 32, 34 and 36 and thus allowing the footrest linkage to be moved to a retracted position upon application of downward leg pressure on the footrest 18 as described above.

Stop Mechanisms

The TV position of the chair including the extended position of the footrest linkage may be governed by any suitable stop mechanisms, however, in the preferred embodiment, a stop 150 is provided on footrest mounting link 110 to engage the upper edge of parallel link 104 of the footrest linkage when the footrest linkage has been extended to the limit desired as shown in FIGS. 4 and 5. It should be noted that although stop 150 stays engaged with parallel link 104 when the chair moves from the TV position shown in FIG. 4 to the fully reclined position shown in FIG. 5, the entire footrest linkage is free to undergo a slight amount of movement in a clockwise direction as viewed in FIGS. 4 and 5 relative to the seat when the four-bar linkage 30, 32, 34 and 36 opens upon movement of the chair into the fully reclined position so as to adjust the position of the footrest into a comfortable plane relative to the fully reclined seat.

Stop 150 also determines the normal or upright position of the chair and of course the closed position of the footrest linkage. This is illustrated in FIG. 2 where the footrest linkage is closed and the stop 150 engages the edge of footrest mounting link 104 to define the closed position of the footrest. Furthermore, since the seat mounting link 50 is actuated by the footrest linkage through transmission link 90 when the chair is being returned to upright or normal position, the limitation of the footrest movement to closed position by stop 150 also serves to limit the rearward movement of the seat mounting link 50 and four-bar seat linkage 30, 32, 34 and 36 relative to the base.

In order to limit the downward movement of seat link 34 to determine the closed position of the four-bar seat linkage 30, 32, 34 and 36, a stop 152 is provided in the shown embodiment on the forward extremity of the front portion 33 of seat link 32 so as to be engageable with the bottom edge of seat link 34 as shown in FIGS. 2, 3 and 4. As the four-bar seat linkage opens when the chair is moving to the full reclined position shown in FIG. 5 from the TV position shown in FIG. 4, seat link 34 moves above and out of engagement with stop 152, and the fully opened position of the four-bar linkage is determined by another stop 154 which may be provided on the main seat link 30 as shown to be engageable with the upper edge of leg **36*b* of seat link 36 as shown in FIG. 5. Although not shown, any other suitable stop mechanism may be employed instead of stop 154. For example, a slotted link may be pivoted to seat link 34 so as to receive a stop which would engage the end of the slot when the seat linkage is in the fully opened position. Perhaps it should also be noted that the fully closed position of the four-bar seat linkage 30, 32, 34 and 36 is also determined to a certain degree by the sequencing link but it is preferred that a positive definition of this position be provided such as through the use of stop 152** as indicated.

Operation

Operation of the chair will now be summarized. When the chair is in the normal or upright position shown in FIG. 1A with the linkage systems closed as shown in FIGS. 2 and 3, should the occupant lean back in the chair exerting pressure on the backrest, it will have no effect of extending the footrest or otherwise placing the chair into a reclining position. The latter effect is achieved by the sequencing link 140 which maintains the four-bar seat linkage closed until such time as the chair has been moved to TV position through the use of armrests 20.

If it is desired to move the chair into TV position, the occupant merely grasps the armrests 20 and moves them forwardly relative to the fixed base 12. This will cause the armrest link 70 which is fixed to the armrests 20, to actuate, through the actuating linkage 80 and 86, the main seat mounting link 50 forwardly about its pivot 54 to the base 12, that is, in a clockwise direction as viewed in FIGS. 3 and 4. At the same time, the armrest link 70 will actuate through transmission link 90 the footrest linkage to cause the latter to unfold into extended position. The TV position will be determined by engagement of stop 152 on footrest mounting link with link 104. Thus in the TV position of the chair as shown in FIGS. 1B and 4, the entire back and seat assembly including the four-bar seat mounting linkage has been moved with wall-avoiding action forwardly of the base 12 and, at the same time, the seat has been placed into a steeper inclined position than the normal position which it occupies when the chair is in the normal or upright position shown in FIG. 1. It should be noted, however, that the four-bar linkage still remains in closed position when the chair is in the TV position shown in FIG. 4.

Should the chair occupant wish to return the chair to the upright position shown in FIG. 1A, he merely has to exert downward pressure on the footrest 18 which will have the effect of folding the footrest into the retracted position while, at the same time, moving the seat linkage including the seat mounting link 50 rearwardly to return them to the normal position shown in FIGS. 1A, 2 and 3. The retracted position of the footrest will be determined when stop 150 on footrest mounting link 110 engages parallel link 104. This will also determine the normal or upright position of the chair. Although return of the chair from TV to the normal or upright position may be achieved by the occupant exerting downward pressure on the footrest with his legs, it may also be facilitated by simultaneously moving the armrests rearwardly relative to the base. The normal or upright position will be determined by engagement of seat link 34 with stop 152.

On the other hand, should the occupant reclining in TV position desire to move to a fully reclined position shown in FIGS. 1C and 5, he merely has to exert pressure on the backrest by pushing rearwardly off the armrests causing the four-bar seat linkage 30, 32, 34 and 36 to open to thus place the seat and backrest at a steeper incline as shown in FIGS. 1C and 5. The fully reclined position will be determined by engagement of the upper edge of seat link 36 with stop 154 on main seat link 30. The opening of the four-bar linkage will have the effect of raising the entire footrest linkage as a unit together with the front end of the seat linkage and this will cause the transmission link 82 to pull the armrest linkage 70 and, in turn, links 66 and 56 forwardly to provide a certain amount of added wall-avoiding travel of the seat linkage relative to the base. In addition, the opening of the four-bar linkage will have the effect of pivoting the seat link 36 clockwise as viewed in FIGS. 4 and 5 about its pivot 44 to main seat link 30 which will have the effect of adjusting the footrest linkage slightly downwardly relative to the seat linkage to place the footrest at a comfortable position compatible with the fully reclined position of the seat.

Between the TV position shown in FIGS. 1B and 4, and the fully reclined position shown in FIGS. 1C and 5, the occupant may place the chair into a theoretically infinite number of advanced reclining positions depending on how the occupant's weight is distributed by application of pressure on the backrest. These positions as well as fully reclined position may be easily maintained or adjusted by virtue of the occupant's weight distribution.

As long as the chair occupant maintains the chair in the fully reclined position, sequencing link 140 will prevent accidental retraction of the footrest. Should the occupant wish to return the chair to the TV position from the fully reclined position, he merely has to redistribute his weight by leaning forward in the chair reducing pressure on the backrest which will cause the four-bar seat linkage 30, 32, 34 and 36 to close as will be positively determined by stop 152. This will have the effect of moving the sequencing link 140 rearwardly to then permit the footrest to be retracted in the manner indicated.

What is claimed is:

1. A two-way wall-avoiding recliner chair comprising in combination, a base, a seat and backrest interconnected to move as a unit at all times, a seat linkage including a first link (30) fixed to the seat, a mounting linkage mounting the seat linkage to the base for movement between a normal position in which the backrest is generally upright and a first reclined position in which the seat has advanced forwardly of the base from said normal position, said mounting linkage including a main mounting link (50) pivotally connected to said seat linkage and said base, armrests located on opposite sides of the seat, an armrest linkage mounting the armrests to the seat linkage for movement relative to the base, actuating linkage interconnecting the armrest linkage and said main mounting link of the mounting linkage for moving the mounting linkage and in turn the seat linkage to move the seat from said normal position to said first reclined position thereof in response to movement of said armrests forwardly relative to the base and seat, a footrest, footrest linkage mounting the footrest to the seat linkage for movement between a retracted position adjacent the front of the seat and an extended position projected forwardly from the seat, and a transmission means including a transmission link (90) interconnecting the armrest linkage and the footrest linkage for moving the footrest from said retracted position to said extended position thereof when the armrests are moved forwardly relative to the base and seat to move the seat from said normal position to said reclined position.

2. The chair defined in claim 1 wherein said seat linkage includes a four-bar linkage movable from a closed to open position when the chair is in said first reclined position by the chair occupant pushing off the armrests and exerting pressure on the backrest to place the seat in a second, fully reclined position with the footrest maintained in extended position.

3. The chair defined in claim 2 wherein the transmission means and armrest linkage are arranged such that when the chair is moved into the fully reclined position, the seat linkage is pulled forwardly relative to the base by the armrest linkage responding to the transmission linkage to advance the seat forwardly relative to the base.

4. The chair defined in claim 3 wherein the footrest linkage includes a first link (110) pivoted to said first link (30) of the seat linkage and a second link (112) pivoted to a second link (36) of the seat linkage to move the footrest linkage downwardly in a vertical plane about a horizontal axis when the seat is moved into said fully reclined position.

5. The chair defined in claim 2 further including a sequencing linkage means interconnecting the footrest linkage and the seat linkage for preventing retraction of the footrest when the seat is in said fully reclined position.

6. The chair defined in claim 2 wherein said seat linkage includes a second link (36) pivoted to said first link (30) of the seat linkage, and a third link (34) pivoted to said second link; and wherein the footrest linkage includes a first link (112) pivoted to said second link of the seat linkage; and wherein there is included a sequencing link (140) having one end pivoted to said first link (112) of the footrest linkage and an opposite end pivoted to said third link (34) of the seat linkage to prevent retraction of the footrest from extended position when the seat is in said fully reclined position.

7. The chair defined in claim 6 wherein when the chair is in the first reclined position the pivotal connection between the first link (112) of the footrest linkage and the second link (36) of the seat linkage is substantially concentric with the pivotal connection between the sequencing link (140) and the third link (34) of the seat linkage; and when the chair is in said fully reclined position said pivotal connections are spaced one above the other.

8. The chair defined in claim 7 wherein when the seat is in said first reclined position the pivotal connection of the second link (36) of the seat linkage to the third link (34) of the seat linkage is substantially concentric with the pivotal connection between the sequencing link (140) and said footrest link; (112) and when the seat is in said normal position said last two defined pivotal connections are substantially spaced from each other in the forward rearward direction of the chair.

9. The chair defined in claim 2 including a first stop means (154) associated with said seat linkage for defining the open position of the four-bar linkage.

10. The chair defined in claim 9 wherein said first stop means includes a stop (154) fixed to said first link (30) of said seat linkage and engageable with one of the links of said seat linkage when the seat moves into said fully reclined position to determine said fully reclined position.

11. The chair defined in claim 10 further including second stop means (152) engageable with said third link (34) of the seat linkage when the chair is in said normal and first reclined positions thereof to prevent relative movement of the links included in the seat linkage.

12. The chair defined in claim 11 further including a third stop means (150) on the footrest linkage for determining the extended position of the footrest and the limit of forward movement of the seat linkage relative to the base at the first reclined position of the seat.

13. The chair defined in claim 1 wherein said mounting linkage includes a first mounting link (50) pivoted to the base and a second rear mounting link (56) located rearwardly of the first mounting link and being pivoted to the base.

14. The chair defined in claim 13 wherein said armrest linkage includes a first link (66) having one end portion pivoted to an upper portion of the rear mounting link (56) and having an intermediate portion pivoted to said seat linkage.

15. The chair defined in claim 14 wherein said armrest linkage includes a second link (70) having a lower portion pivoted to the other end portion of the first link (66) of the armrest linkage.

16. The chair defined in claim 15 wherein said transmission linkage means includes a link (90) pivotally connected to said second link (70) of the armrest linkage.

17. The chair defined in claim 13 wherein said actuating linkage is connected to said first mounting link (50).

18. The chair defined in claim 15 wherein said actuating linkage interconnects the second link (70) of the armrest linkage and the first mounting link (50).

19. The chair defined in claim 18 wherein said actuating linkage includes a first link (80) pivotally connected to said second link (70) of the armrest linkage and a second link (86) pivotally connected to said first link (80) of the actuating linkage and said first mounting link (50).

20. A linkage system for a two-way wall-avoiding recliner chair of the type including a base, a seat and backrest interconnected to move as a unit at all times and being mounted relative to the base for movement between a generally upright normal position and reclined positions, a footrest mounted to the seat for movement between a retracted position adjacent the front of the seat and an extended position projected forwardly from the seat and armrests located on opposite sides of the seat and being mounted to the seat for movement relative to the base; the linkage system comprising in combination, a seat linkage comprised of a plurality of interconnected links one of which is adapted to be fixed to the seat to move together with the seat, a mounting linkage pivotally connected to the seat linkage and adapted to be pivotally mounted to the base of the associated chair for mounting the seat for movement between said normal and reclined positions, said mounting linkage including a main mounting link pivotally connected to the seat linkage and adapted to be pivotally connected to the base of an associated chair, an armrest linkage including a link adapted to be fixed to an associated armrest, the armrest linkage being pivotally connected to the seat linkage so as to mount an associated armrest relative to the seat linkage, an actuating linkage interconnecting the armrest linkage and said main mounting link of the mounting linkage for actuating the mounting linkage and in turn the seat linkage to move the seat of an associated chair between said normal and reclined positions in response to forward movement of the armrests relative to the associated seat and base, a footrest linkage adapted to be connected to the footrest of an associated chair and being mounted to the seat linkage for moving the associated footrest between extended and retracted positions, and a transmission means including a link interconnecting the armrest linkage and the footrest linkage for moving the associated footrest from retracted to extended positions when the armrest linkage is moved relative to the base.

21. The linkage system defined in claim 20 wherein said seat linkage includes a closed four-bar linkage and wherein the linkage system further includes a stop means for limiting movement of the four-bar linkage beyond an open position.

22. The linkage system defined in claim 21 further including a sequencing link interconnecting the footrest linkage and the seat linkage for preventing retraction of the footrest associated with the footrest linkage when said four-bar linkage is in said open position.

* * * * *